US005265873A

United States Patent [19]

Szilagyi

[11] Patent Number: 5,265,873

[45] Date of Patent: Nov. 30, 1993

[54] GAME OF SKILL

[76] Inventor: Marianne Szilagyi, Hóhenstrasse 42, 8700-Kuesnacht, Switzerland

[21] Appl. No.: 962,933

[22] Filed: Oct. 19, 1992

[30] Foreign Application Priority Data

Oct. 17, 1991 [CH] Switzerland ..... 3040/91

[51] Int. Cl.[5] ..... A63F 7/04

[52] U.S. Cl. ..... 273/113; 273/153 R

[58] Field of Search ..... 273/441, 109, 113, 114, 273/115, 153 R

[56] References Cited

U.S. PATENT DOCUMENTS 591,508 10/1897 Stauber ..... 273/113
622,468 4/1899 Hines ..... 273/113
993,456 5/1911 Naylor ..... 273/115
3,840,234 10/1974 Felsten ..... 273/113
4,008,895 2/1977 Reiner et al. ..... 273/153 R X

*Primary Examiner*—Paul E. Shapiro
*Attorney, Agent, or Firm*—Bachman & LaPointe

[57] ABSTRACT

A game of skill having a housing, which is formed from a transparent, essentially cube-shaped body, which exhibits openings concentric in two mutually perpendicular directions to the sides of the body, the thereby remaining frame, consisting of bars, being hollow and exhibiting bars which form pockets for receiving balls, are located on the common edges of, in each case, one of the three pairs of adjoining sides of the body and are separated by an interspace, and by about a bar length, from two interconnected bars belonging to the adjoining sides.

8 Claims, 1 Drawing Sheet

GAME OF SKILL

BACKGROUND

The invention relates to a game of skill and more particularly a game wherein a plurality of balls are disposed in a closed body and maneuverable therein by a player.

Games of skill, in which one or more balls disposed in a closed body have to be maneuvered into pockets provided for this purpose by suitably skillful rotation, tilting or the like of the closed body by a player are known. There is always a desire for new games of this type of differing designs, in order to satisfy and stimulate the player's instinct.

Accordingly, it is the principle object of the invention to provide a new game of skill as aforesaid which will stimulate the player.

SUMMARY OF THE INVENTION

The foregoing object is achieved by way of the present invention wherein a game comprises a housing containing a plurality of balls movable therein, said housing having pockets for the balls wherein the housing is formed from a transparent, essentially cube-shaped body having adjoining sides defining openings concentric in two mutually perpendicular directions to the sides of the body and further consisting of hollow bars, which form the pockets, the bars being located on common edges of each one of the adjoining sides of the body and are separated by an interspace and by about a bar length, from two interconnected bars belonging to the other adjoining sides.

A game of skill of this type is not only apt to stimulate the play instinct, but also represents an attractive ornament, is relatively simple to manufacture and can also be manufactured as an inexpensive mass-production article.

Further designs of the invention can be derived from the following description.

BRIEF DESCRIPTION OF THE DRAWINGS

The invention is described in further detail below with reference to illustrative embodiments represented in the attached figures.

DETAILED DESCRIPTION

Figure 1:
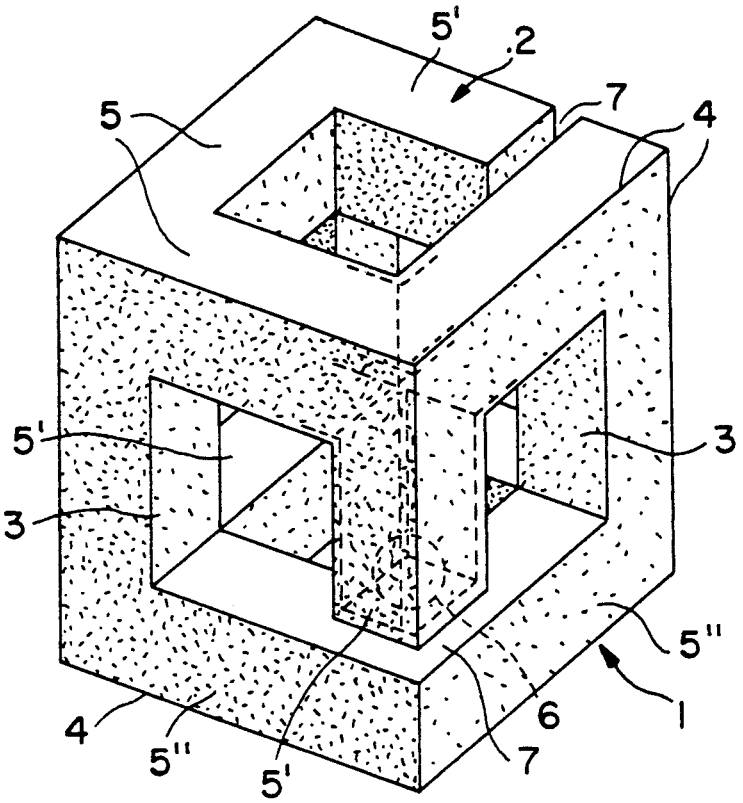
FIG. 1 shows an embodiment of a game of skill in perspective view.

The represented game of skill comprises an essentially cube-shaped, transparent body I, possibly made from clear plastic material, having two central openings 3, Which are square in section and run perpendicular to each other and to the sides 2 of the cube-shaped body 1, and which exhibit a uniform distance from the edges 4 of the cube-shaped body 1, i.e., are disposed concentric to the sides 2 of the cube-shaped body 1, so that a frame is left which is totally hollow and comprises therefore hollow, interconnected bars 5, the bars 5 enclosing, on each side of the cube-shaped body 1, a square opening 3.

In the hollow frame there are provided a plurality, e.g. three, six or nine, of, where applicable, variously colored balls 6, which can be moved along the bars 5 by suitably rotating the cube-shaped body 1 within the hollow frame.

Pockets for receiving the balls 6 are formed by the fact that, in each case, a bar 5', which forms the edge of a pair of a total of three pairs of, in each case, two adjoining sides 2, 2 of the cube-shaped body 11, is disposed adjoined at its end by two interconnected bars 5" of the two sides 2, 2 around a narrow interspace 7 at a distance the bars 5", the three bars 5', which thus exhibit a free end and in each case form a pocket, pointing in three mutually perpendicular directions, and the free ends and the respectively adjoining, interconnected bars 5" of the pair of sides 2, 2 being not adjoined to two bars 5', i.e. the interspaces 7 being disposed, at a distance of about two edge lengths, along a closed path running along edges 4 of the cube-shaped body 1 and comprising, from all sides 2 of the cube-shaped body 1, two adjacent edges 4.

The free ends of the bars 5, can be closed, cf. FIG. 1, but they can also be open if, as also represented in FIG. 1, the bars 5" are closed on the side facing the free end of the bars 5' and the interspace 7 is sufficiently narrow to prevent the balls 6 from falling out.

Figure 2:
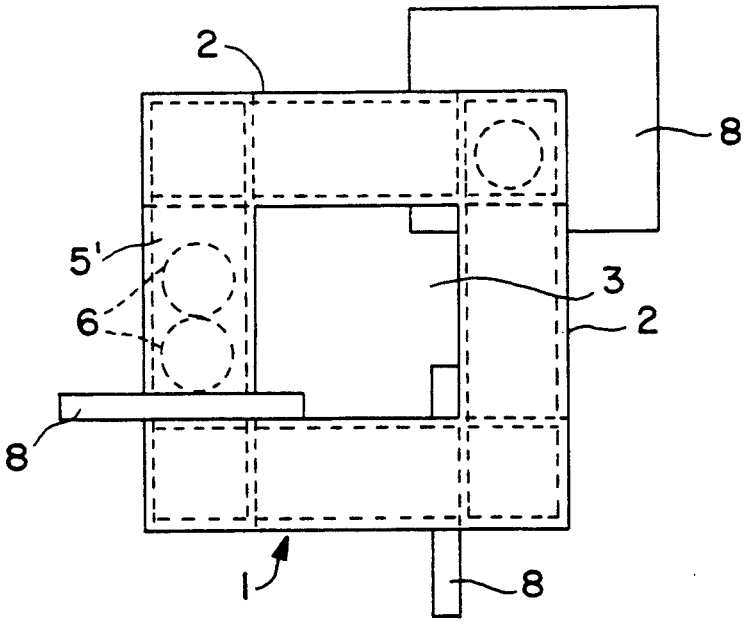
FIG. 2 shows a somewhat modified embodiment, by comparison with FIG. 1, in front view.

The free ends of the bars 5' can also be produced, however, by severing the connection with the bars 5", cf. FIG. 2, so that the balls 6 are able to move from the bars 5' into the bars 5". In the latter case, platelets 8 are used for the configuration of the pockets, which platelets are inserted according to requirement, by a gentle force fit, into the interspaces 7, in order to block the appropriate passage from a bar 5' into the adjoining bars 5". In this case, of course, the interspace 7 should be chosen to have a narrowness such that the balls 6 cannot fall out through it if no platelet 8 is inserted.

By suitably skillful rotation of the cube-shaped body 1, the balls 6 have to be lodged, uniformly distributed, in the bars 5' forming the pockets. Given colored balls 6 and given an appropriate leg length of the bars 5' or of the diameter of the balls 6, three in each case same-colored or three in each case different-colored balls 6, for example, have to be lodged in a bar 5'.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A game of skill comprising a housing containing a plurality of balls movable therein, said housing having pockets for the balls wherein the housing is formed from a transparent, essentially cube-shaped body having adjoining sides defining openings concentric in two mutually perpendicular directions to the sides of the body and further consisting of hollow bars, which form the pockets, the bars being located on common edges of each one of the adjoining sides of the body and are separate by a interspace and by about a bar length, from two interconnected bars belonging to the other adjoining sides.

2. The game of skill as claimed in claim 1, wherein the bars are closed at their free end.

3. The game of skill as claimed in claim 1, wherein the bars are open at their free end and the interspace is smaller than a ball diameter.

4. The game of skill as claimed in claim 3, wherein the bars adjoining the free end of the bars forming the pockets are closed at the side directed toward the free end of the bars.

5. The game of skill as claimed in claim 3, wherein the bars adjoining the free end of the bars forming the pockets are open at the side directed toward the free end of the bars and platelets can be inserted into the interspaces.

6. The game of skill as claimed in claim 1, wherein the cube-shaped body consists of clear plastic material.

7. The game of skill as claimed in claim 1, wherein a plurality of variously colored balls are present in the cube-shaped body.

8. The game of skill as claimed in claim 1, wherein the inside passage cross-section of the bars is somewhat greater than the ball diameter.

* * * * *